US005529375A

United States Patent [19]

English

[11] Patent Number: 5,529,375

[45] Date of Patent: Jun. 25, 1996

[54] BEACH CHAIR LOVE SEAT

[76] Inventor: Billie F. English, 8457 Flagstone Dr., Tampa, Fla. 33615

[21] Appl. No.: 453,802

[22] Filed: May 30, 1995

[51] Int. Cl.[6] ..... A47C 5/10

[52] U.S. Cl. ..... 297/248; 297/40

[58] Field of Search ..... 297/232, 248, 297/249, 257, 381, 382, 54, 35, 40

[56] References Cited

U.S. PATENT DOCUMENTS

| | | | |
|---|---|---|---|
| 123,131 | 1/1872 | Taylor | 297/249 |
| 1,369,543 | 2/1921 | Reider | 297/248 X |
| 1,858,254 | 5/1932 | Uline | 297/248 X |
| 1,955,040 | 4/1934 | Wittcoff | 297/248 X |
| 1,997,027 | 4/1935 | Wittcoff | 297/382 |
| 3,383,738 | 5/1968 | Fox et al. | 297/248 X |

FOREIGN PATENT DOCUMENTS

| | | | |
|---|---|---|---|
| 3227119 | 2/1983 | Germany | 297/232 |
| 590697 | 7/1947 | United Kingdom | 297/381 |

*Primary Examiner*—Peter R. Brown
*Attorney, Agent, or Firm*—American Innovations, Inc.; Dorothy S. Morse

[57] ABSTRACT

Lightweight, collapsible adjoining beach chairs, in the configuration of a love seat, allowing two or more persons to sit together with no separating armrest or other division between them. Each beach chair is individually collapsible and foldably hinged in a side-by-side configuration to at least one adjoining beach chair so that the beach chair love seat may fold into a compact, portable fully collapsed position. Adjoining seat backs are locked together to stabilize the beach chair love seat in its fully opened position.

10 Claims, 2 Drawing Sheets

BEACH CHAIR LOVE SEAT

BACKGROUND—FIELD OF INVENTION

This invention relates to portable, collapsible chairs, specifically to adjoining beach chairs which can be carried as a single unit and in which two or more persons may sit adjacent to one another without any arm rest or other separation coming between them.

BACKGROUND—DESCRIPTION OF PRIOR ART

Prior art chairs include collapsible chairs having seat members pivotally connected to seat backs which fold compactly for storage. Collapsible chairs have also been made of lightweight materials for easy transportation. However, in spite of lightweight construction, it is often awkward for one person to carry two or more collapsible chairs at the same time.

Prior art chairs are also known to have legs, pedestals and other types of seat supports, as well as arm supports. Further, prior art chairs include those designed for more than one person, such as sofas and love seats. However, no prior art chair is known to have two or more collapsible chair seats pivotally connected to one another in a side-by-side configuration so as to fold compactly for portability, and in which two or more persons may sit adjacent to one another without any armrest, separation or other obstruction between them.

SUMMARY OF INVENTION—OBJECTS AND ADVANTAGES

It is a primary object of this invention to provide pivotally connected portable, collapsible beach chairs wherein two or more persons may sit adjacent to one another without separation or obstruction between them. Another object of this invention is to provide a lightweight beach chair for more than one person which folds into a compact shape so that it may be transported easily from one location to another. The beach chair love seat, with its multiple seats compactly folded and attached together, will have an advantage over prior art collapsible chairs of being easier to carry than two or more independent beach chair units. It is also an object of this invention to provide stabilization for the beach chair love seat in its fully opened position.

DETAILED DESCRIPTION OF PREFERRED EMBODIMENTS

Figure 1:
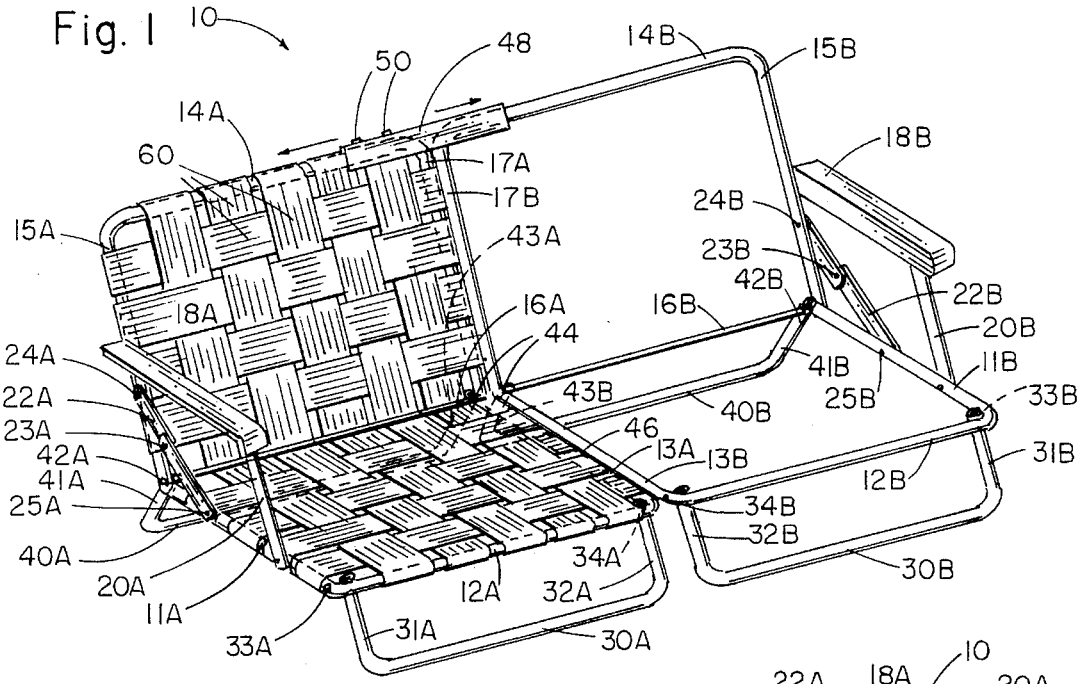
FIG. 1 is a perspective view of the invention opened out for use.

FIG. 1 shows the beach chair love seat 10 having a generally U-shaped right seat portion 12A and an adjoining, generally U-shaped left seat portion 12B. Only the right-hand seat assembly shall be described in its entirety. It shall be understood that each part identified in the right-hand seat assembly with a numeral and the suffix "A" shall have a corresponding left-hand seat assembly part with the same numeral followed by the suffix "B." It should also be noted that in FIGS. 1, 2 and 3 the webbing 60 is only shown in the right-hand seat assembly, having been omitted from the left-hand seat assembly solely for clarification of the structural components of the beach chair love seat 10.

The generally U-shaped right seat portion 12A has rearward extensions 11A and 13A. Downward extensions 15A and 17A of a generally upright inverted U-shaped seat back 14A are hinged to seat extensions 11A and 13A by means of a transverse rod 16A.

Figure 4:
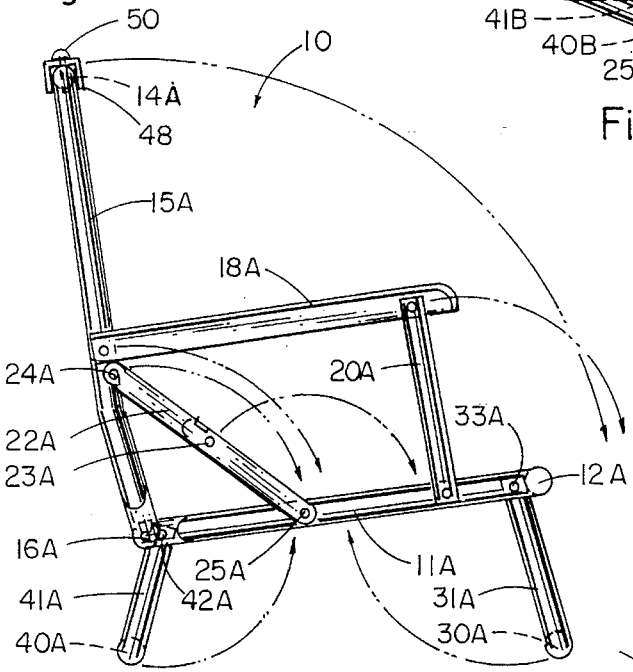
FIG. 4 is left side elevational view of the invention opened out for use.

Both FIGS. 1 and 4 show an arm rest 18A pivotally attached at an appropriate level to back extension 15A. The near forward end of armrest 18A is pivotally attached to one end of a connecting tube 20A. The opposite end of connecting tube 20A is pivotally attached near the forward portion of seat extension 11A. Forward of transverse rod 16A is a conventional folding brace 22A, hinged at its center 23A. One end of folding brace 22A is attached to back extension 15A as at 24A, while the opposite end of folding brace 22A is attached to seat extension 11A as at 25A.

FIGS. 1 and 4 also show an inverted generally U-shaped front base member 30A and an inverted generally U-shaped rear base member 40A. Front base member 30A has upward extensions 31A and 32A, front base extension 31A being pivotally attached to seat extension 11A as at 33A and front base extension 32A being pivotally attached to seat extension 13A as at 34A. Similarly, rear base member 40A has upward extensions 41A and 43A, rear base extension 41A being pivotally attached to seat extension 11A as at 42A and rear base extension 43A being pivotally attached to seat extension 13A as at 44.

As rear base member 40A is brought to bear against transverse rod 16A, rear base member 40A is locked into place. Similarly, when front base member 30A is brought to bear against right seat portion 12A, front base member 30A is locked into place thereby helping to stabilize the entire right-hand seat. Folding brace 22A further helps stabilization by locking seat back 14A and armrest 18A in place when beach chair love seat 10 is fully opened for use.

Figure 2:
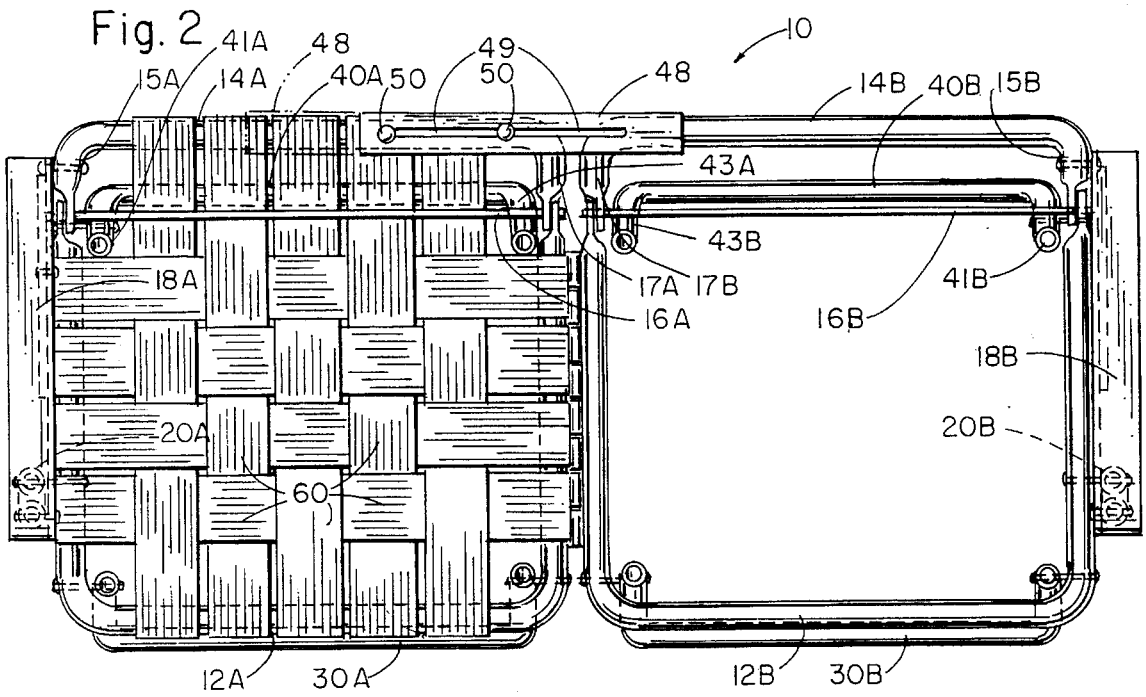
FIG. 2 is a top planar view of the invention opened out for use.
Figure 3:
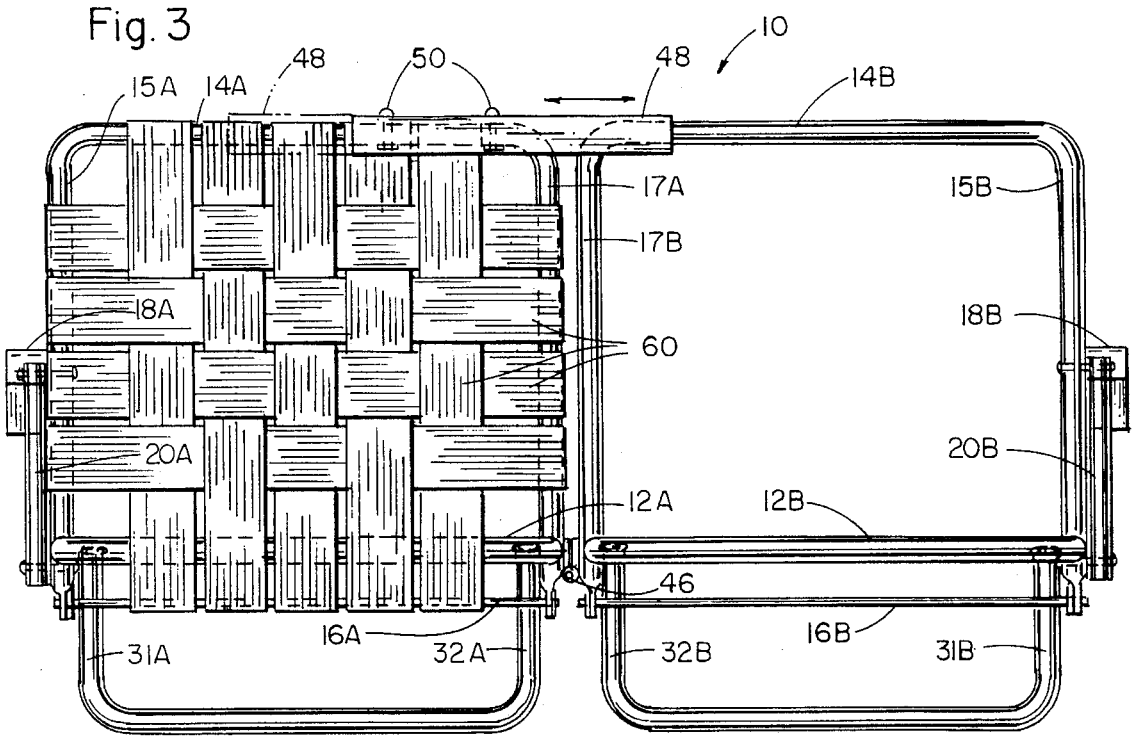
FIG. 3 is a front elevational view of the invention opened out for use.

As shown in FIGS. 2 and 3, beach chair love seat 10 is also stabilized in its fully opened position by a slidable U-shaped channel bracket 48 which locks seat backs 14A and 14B together. Channel bracket 48 has an elongated slot 49 and is attached to the upper left portion of seat back 14A by means of two rivets 50. Channel bracket 48 is sized and positioned so that a portion of channel bracket 48 may slidably engage the upper right portion of seat back 14B when beach chair love seat 10 is fully opened for use.

Figure 5:
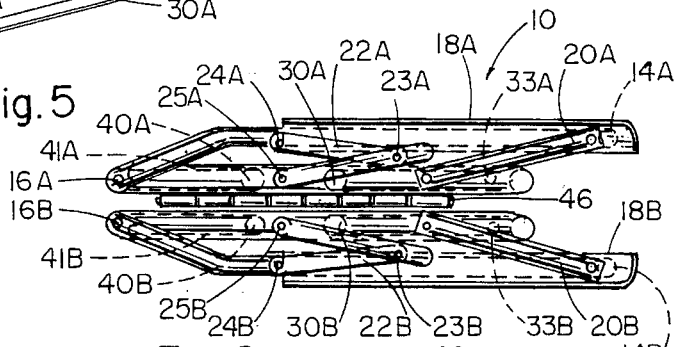
FIG. 5 is a left side elevational view of the invention in its fully collapsed configuration.
Figure 6:
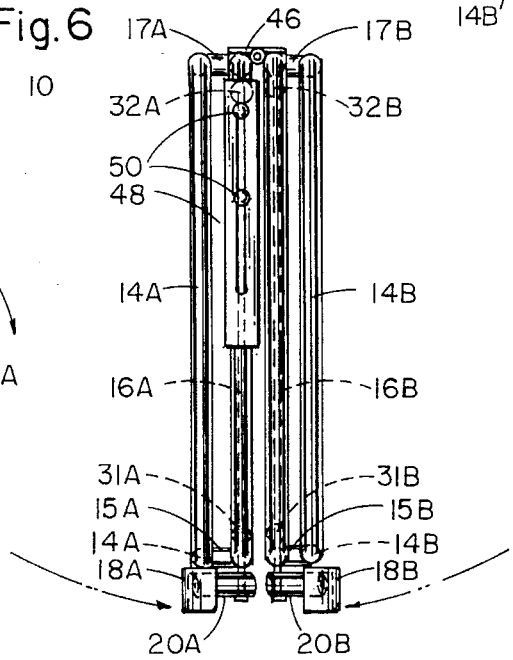
FIG. 6 is a front elevational view of the invention in its fully collapsed configuration.

FIGS. 5 and 6 show beach chair love seat 10 in its fully collapsed position. A piano hinge 46 located between seat extensions 13A and 13B connects right seat portion 12A to left seat portion 12B. To collapse beach chair love seat 10, both front base member 30A and rear base member 40A are pivoted inward between seat extensions 11A and 13A. Similarly, front base member 30B and rear base member 40B are pivoted inward between seat extensions 11B and 13B. Channel bracket 48 must then be slidably disengaged from seat back 14B so that seat backs 14A and 14B can be pivoted toward seat portions 12A and 12B, respectively. Thereafter, beach chair love seat 10 can be placed into its fully collapsed compact position by pivoting seat portions 12A and 12B toward each other at piano hinge 46. A strap handle (not shown) could facilitate carrying beach chair love seat 10 while in its fully collapsed position.

Although FIGS. 1 through 6 show beach chair love seat 10 with two seat assemblies for clarity, it is contemplated that beach chair love seat 10 could be made to incorporate one or more additional seat assemblies without armrests (not shown). The seat portion of each additional seat assembly would be hinged in a side-by-side configuration between seat portions 12A and 12B of the right and left seat assemblies shown in FIGS. 1 through 6.

SUMMARY, RAMIFICATIONS AND SCOPE

The above description provides preferred embodiments of the present invention but should not be construed as limiting the scope of the beach chair love seat invention. Different seat and back shapes, different handles, fabric other than webbing material and additional arm support and brace designs, other than those shown, could be incorporated into the present invention. Also, accessories could be added to the beach chair love seat, such as sealable storage pouches attached to the rearward surface of the seat backs or to the underneath surface of the seat portions; means to hold an umbrella; or means to hold or store beverage containers. Further, means other than a piano hinge could be used to connect adjoining seats. Thus the scope of the present invention should be determined by the appended claims and their legal equivalents, rather than the examples given.

What is claimed is:

1. A beach chair love seat which may be collapsed into a compact configuration and also fully opened for use comprising a plurality of collapsible chairs, each of said collapsible chairs having a seat portion and a seat back, each of said seat portions having a back edge and lateral edges, each of said back edges of said seat portions being pivotally connected to one of said seat backs, at least one of said lateral edges of each of said seat portions being pivotally connected to one of said lateral edges of another of said seat portions so as to form a row of connected seat portions wherein two of said collapsible chairs have an unconnected side, said beach chair love seat further comprising a first means of pivotal connection attached between each of said lateral edges of said connected seat portions, a second means of pivotal connection attached between each of said back edges of said seat portions and one of said seat backs, a plurality of channel brackets for stabilizing said beach chair love seat when fully opened for use, each of said channel brackets being slidably attached to one of said seat backs, each of said channel brackets also being of sufficient length so as to engage and lock an adjoining seat back into a fixed position with the seat back to which said channel bracket is attached, and means to slidably attach each of said channel brackets to one of said seat backs.

2. The beach chair love seat of claim 1 further comprising a plurality of rivets and each of said channel brackets having an elongated slot, and wherein said means to slidably attach each of said channel brackets to one of said seat backs comprises at least one of said rivets affixing each of said channel brackets to one of said seat backs through said elongated slot so that said rivets act as a stop for said elongated slot when it is moved between engaged and disengaged positions.

3. The beach chair love seat of claim 1 wherein said stabilization means further comprises two conventional folding braces, one of said folding braces being attached to one of said unconnected sides and the other of said folding braces being connected to the other of said unconnected sides.

4. The beach chair love seat of claim 3 wherein said first means for pivotal connection comprises a plurality of conventional piano hinges, at least one of said piano hinges being attached between each of said lateral edges of said connected seat portions and wherein said second means for pivotal connection comprises at least one transverse rod attached between each of said back edges or said seat portions and one of said seat backs.

5. The beach chair love seat of claim 4 further comprising a handle for carrying said beach chair love seat in its fully collapsed position.

6. The beach chair love seat of claim 3 further comprising two arm rests, one of said arm rests being attached to one of said unconnected sides and the other of said armrests being attached to the other of said unconnected sides.

7. The beach chair love seat of claim 1 further comprising a plurality of base members and means to pivotally connect said base members to said seat portions, and wherein at least one of said base members is pivotally connected to each of said seat portions.

8. The beach chair love seat of claim 1 further comprising two arm rests, one of said arm rests being attached to one of said unconnected sides and the other of said armrests being attached to the other of said unconnected sides.

9. A beach chair love seat comprising a plurality of collapsible chairs, a plurality of transverse rods, a plurality of conventional piano hinges, a plurality of base members, two arm rests, two conventional folding braces, a plurality of channel brackets, and a plurality of rivets, each of said collapsible chairs having a seat portion and a seat back, each of said seat portions having a back edge and lateral edges, at least one of said transverse rods pivotally connecting each of said back edges of said seat portions to one of said seat backs, at least one of said piano hinges pivotally connecting each of said lateral edges of said seat portions to one of said lateral edges of another of said seat portions so as to form a row of connected seat portions, wherein two of said collapsible chairs have an unconnected side, one of said armrests and one of said folding braces being attached to each of said unconnected sides between said seat portion and said seat back, each of said channel brackets having an elongated slot, at least one of said rivets attaching each of said channel brackets to one of said seat backs through said elongated slot so that said rivets act as stops for said elongated slot when it is moved between engaged and disengaged portions, at least one of said base members being pivotally connected to each of said seat portions, and means to pivotally connect said base members to said seat portions so that said beach chair love seat may be fully opened for use and also collapsed into a compact configuration.

10. The beach chair love seat of claim 9 further comprising a handle for carrying said beach chair love seat in its fully collapsed position.

* * * * *